US005716332A

United States Patent [19]

Noble

[11] Patent Number: 5,716,332

[45] Date of Patent: Feb. 10, 1998

[54] BODY MASSAGER

[76] Inventor: Edward D. Noble, 25 Austin Dr. #821, Unionville, Ont., Canada, L3R 8H4

[21] Appl. No.: 551,204

[22] Filed: Oct. 31, 1995

Related U.S. Application Data

[63] Continuation-in-part of Ser. No. 223,183, Apr. 5, 1994, abandoned.

[51] Int. Cl.[6] ..... A61H 23/02

[52] U.S. Cl. ..... 601/108; 601/107; 601/110; 601/111

[58] Field of Search ..... 601/72, 107, 108, 601/110, 111, 84

[56] References Cited

U.S. PATENT DOCUMENTS

| | | | |
|---|---|---|---|
| 1,377,140 | 5/1921 | North | 601/108 |
| 4,025,809 | 5/1977 | Teranishi | 601/72 |
| 4,149,530 | 4/1979 | Gow | 601/72 |
| 4,150,668 | 4/1979 | Johnston | 601/94 |

*Primary Examiner*—Robert A. Hafer
*Assistant Examiner*—Benjamin K. Koo
*Attorney, Agent, or Firm*—Bereskin & Parr

[57] ABSTRACT

A body massager including a casing having a slender elongate handle with a massage head extending generally transversely of the handle at one end. The massage handle has an external massage surface contoured symmetrically about a median plane and is mounted for pivotal rocking movement about an axis in that plane. The handle is arranged so that its longitudinal axis also lies in that plane and the massager is balanced about the plane. The massage head is driven by an electric motor which is suspended from an overhead motor mount bracket. Rocking movement of the massage head is controlled by a pair of resiliently compressible sleeves on opposite side of the pivot axis for the head. The massage surface is provided by hemispherical formations which have removable covers so that internal cushion members can be changed for different massage effects.

4 Claims, 4 Drawing Sheets

BODY MASSAGER

This is a continuation of application Ser. No. 08/223,183 filed Apr. 5, 1994, now abandoned.

FIELD OF THE INVENTION

This invention relates generally to power operated body massagers.

BACKGROUND OF THE INVENTION

Traditionally, doctors, chiropractors and other professional therapists have used power operated massagers to give treatment involving manipulation of body structures. Therapy of this type has been found particularly effective in treating muscle tension and fatigue, for example in athletes.

DESCRIPTION OF THE PRIOR ART

Generally, most prior art massagers exert an orbital rubbing action on the body. However, this type of action often causes irritation or other discomfort to the patient. Further, it is thought that the therapeutic effect of this type of rubbing action may not be particularly beneficial and that a percussive massage action may be preferred. Massagers operating on this principle have also been proposed. Examples are shown in U.S. Design Pat. No. 261,428 and in U.S. Pat. No. 4,150,668.

U.S. Pat. No. 4,730,605 issued Mar. 15, 1988 to Edward D. Noble and Duke Harding and assigned to Wellness Innovations Corp. also discloses a percussive massager. This particular massager is designed primarily for use by health professionals, rather than for home use. The massager has a casing with two handles, one at each side, and is intended for two-handed operation. As such, it is difficult to use the massager for self massage, other than on frontal portions of the body. Except through unusual body contortions, it is virtually impossible for the person holding the massager to use it on his or her own shoulder areas, for example.

Accordingly, an object of the present invention is to provide a massager that is specifically designed so as to be capable of use for self massage.

The invention also aims to provide other improvements in percussive massagers generally.

SUMMARY OF THE INVENTION

According to the invention there is provided a body massager comprising: a base structure, a massage head having an external massage surface contoured symmetrically about a median plane generally normal to a notional plane representing a surface to be massaged, the massage head being coupled to the base structure for pivotal rocking movement about a pivot axis in said median plane for exerting a percussive massage effect; and, a drive unit carried by said base structure and coupled with said massage head for producing said rocking movement of the head.

The base structure includes a casing having a slender elongate handle for manipulating the massager, the handle extending about a longitudinal axis and being disposed with said axis in said median plane, the massager being balanced about said plane.

The drive unit comprises an electric motor having a driven rotary output shaft, and a link extending between the output shaft and the massage head and including an eccentric bearing on said shaft. The link is coupled to the massage head at a position spaced from said median plane for converting rotary motion of the output shaft into rocking motion of the massage head about said pivot axis. The electric motor is positioned with its output shaft co-incident with said longitudinal axis of the handle.

The massager further comprises means coupled to and extending downwardly from the motor for mounting the massage head for rocking motion about the pivot axis, and a pair of resilient members disposed between the massage head and said mounting means so as to be alternately and oppositely compressed and relaxed as a consequence of said rocking movement of the massage head, for controlling the rocking movement.

The massage surface is contoured to provide at least two generally hemispherical massage formations disposed symmetrically on opposite sides of the median plane.

It has been found that a massager having these features is particularly suitable for self massage and as such is appropriate for home use. By virtue of the slender elongate form of the handle, the user can hold the massager in one hand and can conveniently reach most areas of his or her own body on which a massage effect is required. The massager is stable in use and does not vibrate or rock in such a way as to make it difficult to hold. Since the massager is balanced about a median plane which is contains the pivot axis of the massage head and the longitudinal axis of the handle, the rocking motion that is imparted to the massage head when the massager is in use tends to cause a reaction that manifests itself as a slight back and forth twisting action of the handle about its longitudinal axis. This action can readily be resisted by the user grasping the handle. There are no reactive forces that make it difficult to hold the massager.

Preferably, the drive motor is coupled to the base structure of the massager by a mounting bracket that extends upwardly from the handle and embraces the motor from above, so that the motor is essentially suspended from the base structure. A bracket that depends from the motor can then be used to carry a pivot shaft about which the massage head can rock. In this aspect of the invention the motor essentially becomes part of the base structure of the massager.

Each massage formation of the massage head may be defined by a relatively rigid dome-shaped inner base element, a generally hemispherical outer cover removably coupled to the base element, and an intermediate and separate cushion member disposed between the base element and the cover and held to the base element by the cover. The characteristics of the cushion member are selected to provide the required massage effect. The cushion member can be changed for another cushion member having different massage characteristics, simply by removing the cover, changing the cushion member and replacing the cover. In this way, the massage characteristics of the massager as a whole can easily be changed.

BRIEF DESCRIPTION OF THE DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

The drawings show what might be termed a "self use" body massager designed for one-handed operation (although there is of course no limitation to self use). The massager has a generally T-shaped configuration overall, and comprises a slender elongate handle with a transverse portion at one end.

Figure 1:
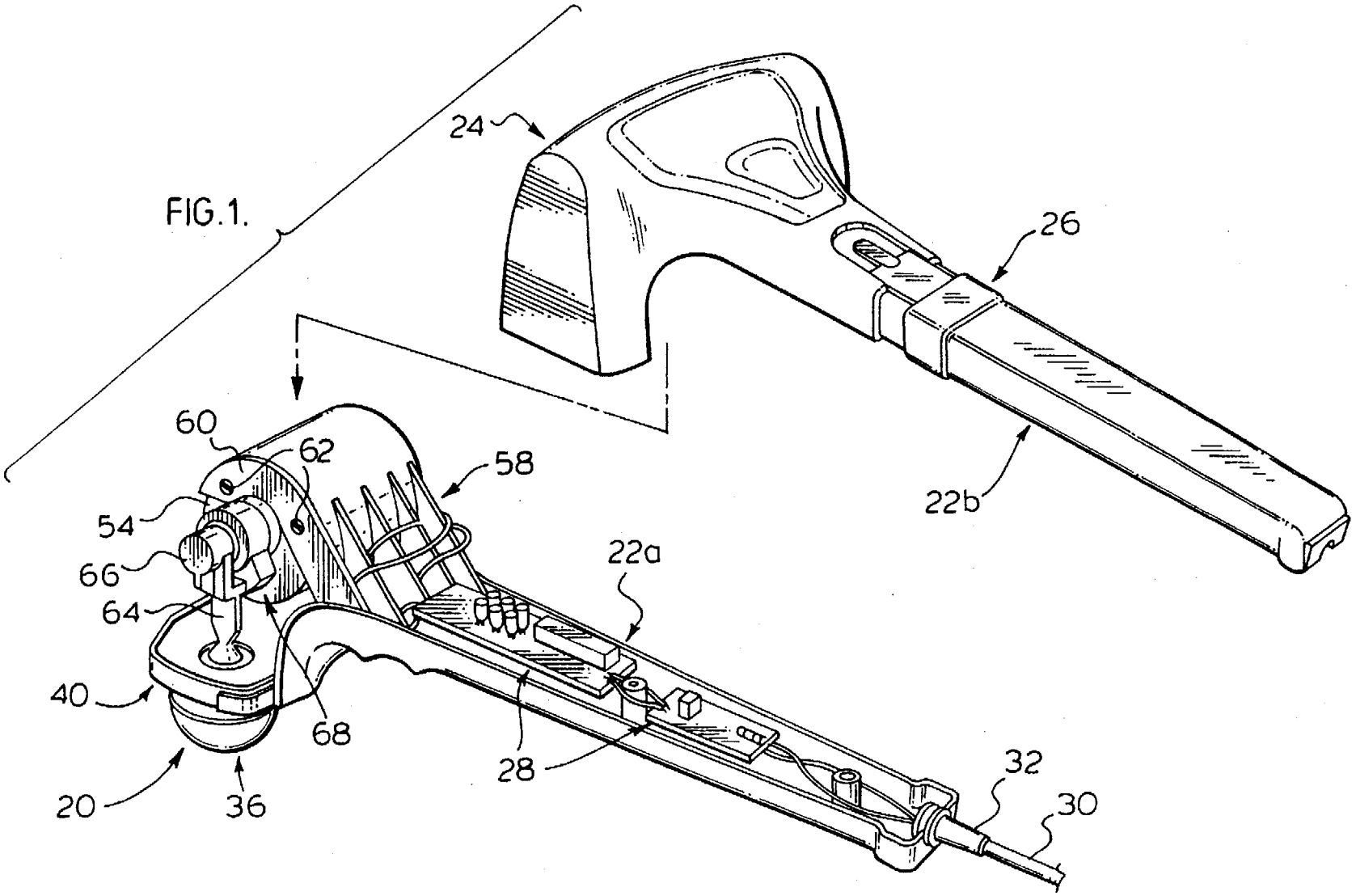
FIG. 1 is a partially exploded perspective view of a body massager in accordance with a preferred embodiment of the invention.

In FIG. 1, the massage head is generally indicated by reference numeral 20 but is only partly visible. The handle includes a fixed lower handle portion 22*a* and a removable, upper handle portion 22*b* which is part of a larger plastic moulding generally denoted 24. When assembled, moulding 24 is fitted to the base structure and held in place by screws (not shown). The moulding forms a shroud or casing which encloses the working parts of the massager. An electrical slide switch generally indicated at 26 is incorporated in the moulding for switching the massager on and off.

The lower handle portion 22*a* is also a plastic moulding and acts as a housing for other electrical components generally indicated at 28. A power cord 30 extends from the distal end of the handle, via a grommet 32. When the massager is assembled, the switch 26 cooperates with electrical components 28 to allow the drive unit of the massager (to be described) to be switched on and off. Since the electrical components themselves and the particular configuration of the switch are not part of the present invention and may be conventional, details thereof have not been given.

Figure 2:
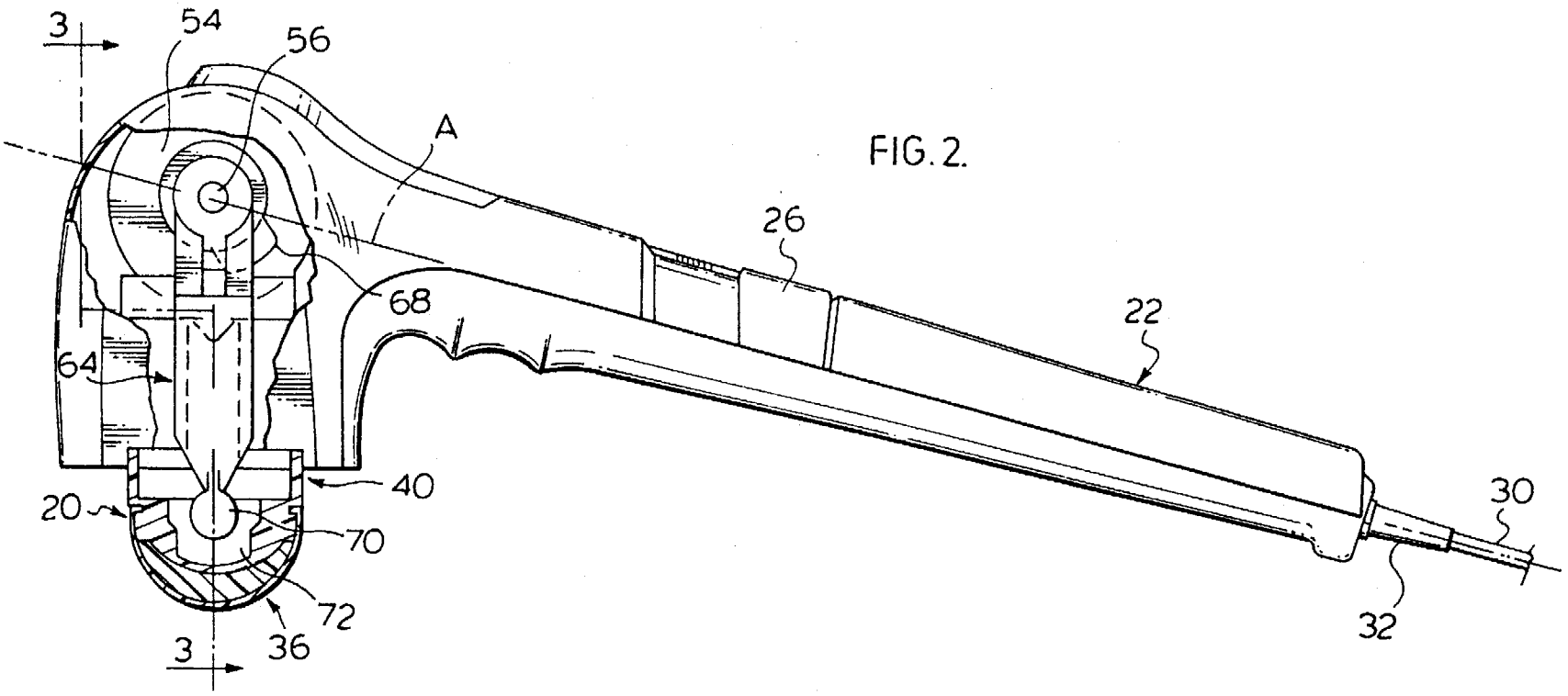
FIG. 2 is a side elevational view corresponding to FIG. 1, with the massager shown assembled and the casing partly broken away.

FIG. 2 shows the massager assembled and perhaps better illustrates the slender elongate configuration of the handle. FIG. 2 also shows that the handle extends about a longitudinal axis A.

Figure 3:
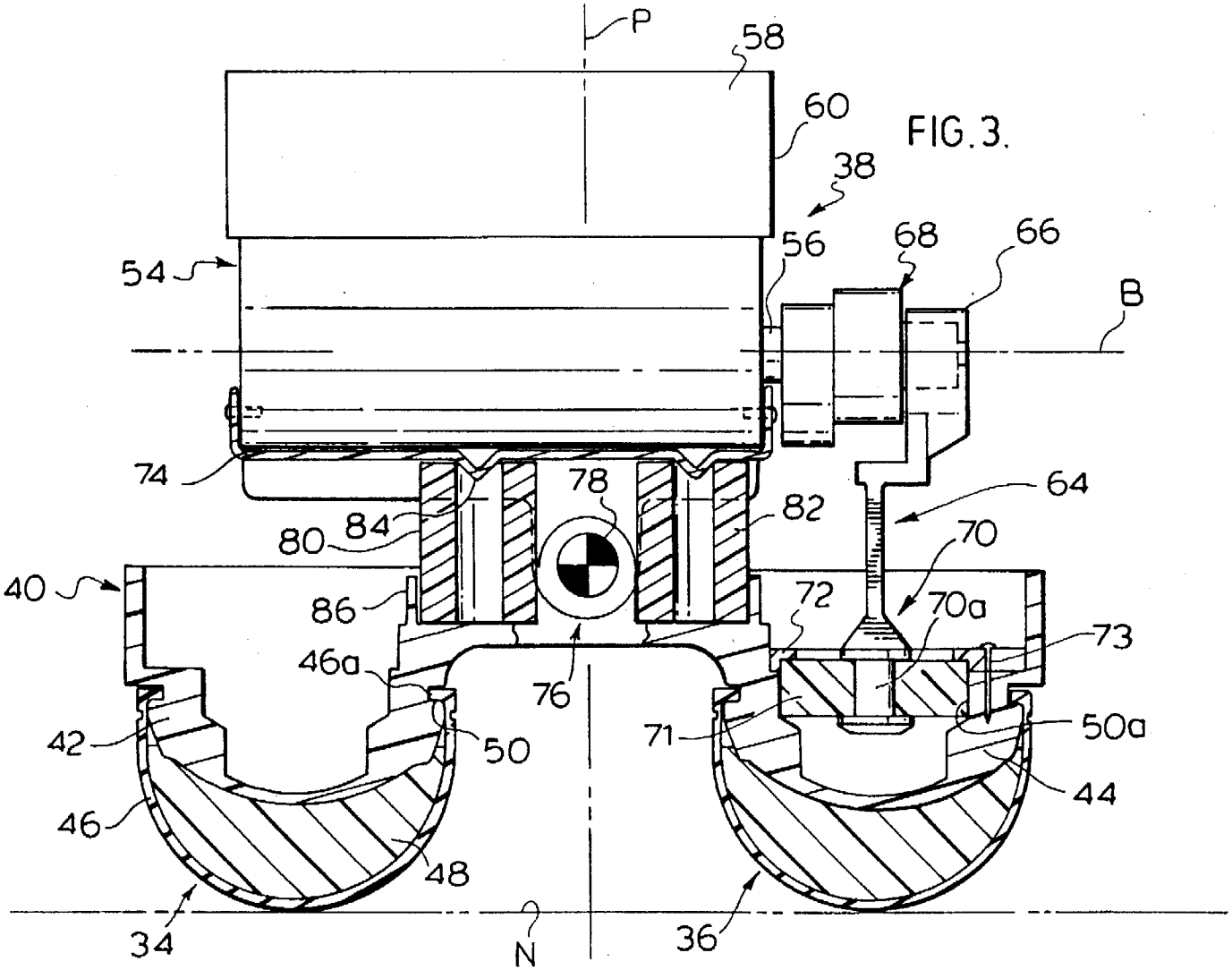
FIG. 3 is a sectional view generally along the line denoted 3—3 in FIG. 2.

FIG. 3 shows the massage head 20 in detail. The head has an external massage surface that is contoured symmetrically about a median plane P generally normal to a notional plane N representing a surface to be massaged. The actual massage surface of the massage head is, in this embodiment, defined by a pair of generally hemispherical structures denoted 34 and 36 which are symmetrical about plane P. The two structures are essentially identical except that one of the structures is coupled to a drive unit 38 (to be described) of the massager.

In this embodiment, the massage surface is shown as being provided by two hemispherical structures only, but it is to be understood that a larger number of hemispheres could be provided symmetrically about plane P. Reference may be made to the assignee's U.S. Pat. No. 4,730,605 for an illustration of a multiple hemisphere massage surface.

The massage head includes a base 40 which is a relatively rigid plastic moulding shaped to provide a pair of dome-shaped inner base elements 42 and 44 within the respective massage hemispheres 34 and 36. Referring to hemisphere 34 by way of example, the massage sphere is completed by a generally hemispherical cover 46 and an intermediate cushion member 48 that occupies substantially the entire space between the base element 42 and the cover 46. Cover 46 is a rubber or other resilient moulding of hemispherical shape with an inwardly directed flange 46*a* generally at the diameter of the hemisphere, which engages in a complimentary groove 50 around the base of the dome-shaped base element 42. Thus, cover 46 can be removed by resiliently distorting the cover so as to pull the flange 46*a* out of groove 50. Cushion member 48 may be made of foam rubber or other resilient material having characteristics selected to provide for an appropriate massage effect on the surface S to be massaged. By removing cover 46 and replacing the cushion member 48 with a member having different characteristics, the massage effect can be varied as desired.

Figure 5:
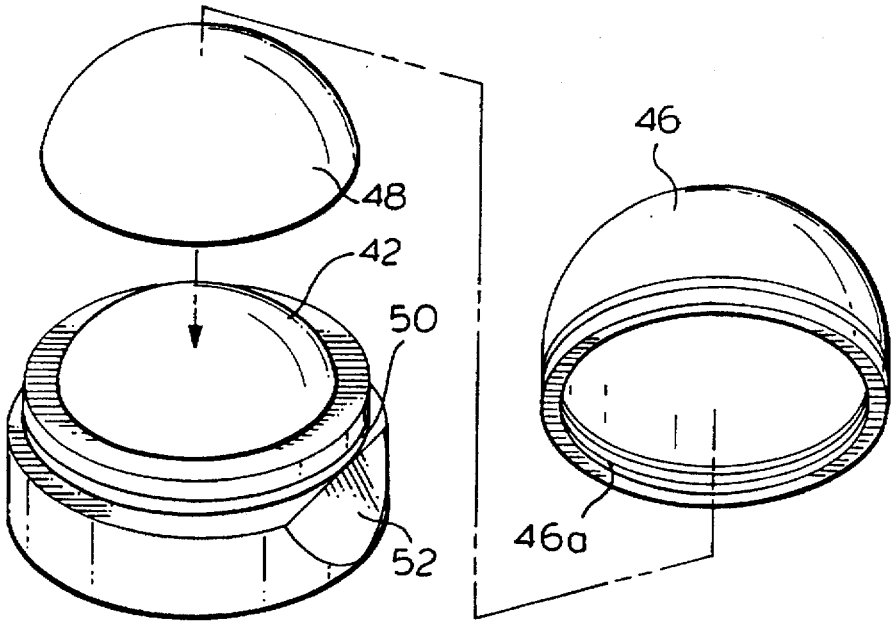

In practice, the massager would be inverted, the cover 46 essentially "rolled" out of the groove 50 by an upward rolling action applied to the perimeter of the cover, for example by the user's thumbs. FIG. 5 shows by way of example, hemisphere 34 in this orientation with the cover 46 and the cushion member 48 shown in exploded positions. A chamfered surface 52 is provided on moulding 40 adjacent groove 50 to aid removal of the cover in this fashion.

It should be understood that this aspect of the invention may be applied to massagers other than of the form specifically described and illustrated herein. For example, this aspect of the invention could be applied to a massager of the form shown in the '605 patent mentioned above.

Referring back to FIG. 3, drive unit 38 comprises an electric motor 54 which has an output shaft 56 extending about an axis B normal to median plane P. In other words, the motor is disposed with its axis transverse to the longitudinal axis A of the massager handle 22 (as shown, for example, in FIG. 1). With continued reference to that view, it will be seen that motor 54 is mounted to the lower handle portion 22*a* of the massager by a motor mount bracket 58 that extends upwardly from the lower handle portion and curves over and around the casing of the electric motor so as to in effect embrace the motor from above. End portions of the bracket 58, one of which is visible at 60, extend across respective end portions of the motor casing and are secured thereto by screws 62 so that the motor is in effect suspended from bracket 58. In this particular embodiment, the motor mounting bracket 58 is formed integrally as part of the same plastic moulding as lower handle portion 22*a*, although it is to be understood that this is not essential. It should also be noted that this form of "suspension" motor mount can be used in a form of massager other than that specifically described herein.

It can also be seen from FIG. 1 that the motor output shaft 56 is coupled to the massage head by a link 64 which is captive on the outer end of shaft 56 but within which the shaft can rotate. Link 64 is a plastic moulding which provides at its upper end an eccentric bearing 66 on shaft 56. Accordingly, as shaft 56 rotates, link 64 imparts a generally up and down oscillatory motion to the massage head. An eccentric counterbalance weight 68 is also provided on shaft 56 to dynamically balance the drive unit and avoid undesirable vibrations when the drive motor is running.

As best seen in FIG. 3, link 64 has at its lower end an enlarged head 70 which includes a shank 70*a* of reduced diameter, to which is fitted a resilient annular disk 71. Disk 71 is held in place in a recess 50*a* in the plastic moulding 40 of the massage head by a ring 72 that is secured to the moulding by three screws, one of which is shown at 73. Ring 72 is generally annular but has a flat across its external circumferential edge.

It was noted previously that motor 54 is suspended from motor mount bracket 58. The massage head 20 is in turn suspended from motor 54 by a bracket 74 (FIG. 3) that is bolted to the motor casing in much the same fashion as motor mount bracket 58 (see FIG. 1). Bracket 74 carries a depending sleeve indicated as 76, which aligns with a pair of similar sleeves (not specifically shown) on the massage head moulding 40. The sleeves on the moulding are at opposite ends of sleeve 76 and a pivot pin 78 connects the three sleeves and provides for pivotal mounting of the massage head on bracket 74. It will be seen that pivot pin 78 is positioned on the median plane P of the massage head.

Rocking motion of the massage head about pivot pin 78 is controlled by a pair of resiliently compressible sleeves 80, 82 that are disposed on opposite sides of the pivot pin 78 and extend between the massage head moulding 40 and the motor bracket 74. It will be appreciated from FIG. 3 that the two sleeves 78 and 80 are alternately and oppositely compressed and relaxed as the massage head 20 rocks about pivot pin 78. The sleeves act to in effect damp the rocking motion. By appropriately selecting the dimensions and characteristics of the sleeves the amount of damping and hence the nature of the percussive massage action can be appropriate controlled.

Figure 4:
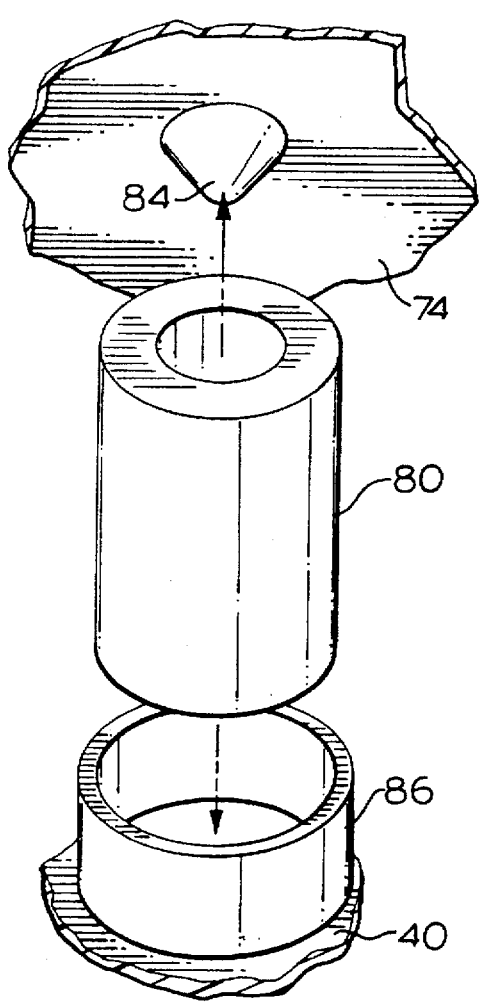
FIGS. 4 and 5 are somewhat schematic exploded perspective views illustrating other features of the massager.

FIG. 4 shows sleeve 80 by way of example and illustrates in some detail how the sleeve is located between the motor bracket 74 and moulding 40. Thus, it will be seen that a generally cone-shaped depression or "dimple" 84 extends downwardly from bracket 74 into the upper end of the sleeve. At its lower end, sleeve 80 is received in an annular formation 86 on moulding 40. It will be appreciated that this arrangement allows the sleeves to be changed quite easily if necessary.

As noted previously, an important feature of applicant's invention is that the massager has a slender elongate handle extending about an longitudinal axis that is positioned in the median plane of the massage head and that that plane also contains the pivot axis for the head. As shown in FIG. 2, the axis A of the handle is also positioned to intersect the longitudinal axis B of the drive unit motor 54. It is also important that the massager be symmetrically balanced about median plane P by appropriate design and positioning of the various components of the massager and, in particular, appropriate positioning of the motor and its associated components with respect to plane P (see FIG. 3).

It should finally be noted that the preceding description relates to a particular preferred embodiment of the invention only and that many modifications are possible within the broad scope of the invention. Some of those modifications have been indicated previously and others will be apparent to a person skilled in the art. In particular, it should be noted that various features of the invention may be used independently of other such features, as has been noted above.

I claim:

1. A body massager comprising:

a base structure;

a massage head having an external massage surface contoured symmetrically about a median plane generally normal to a notional plane representing a surface to be massaged, the massage head being coupled to the base structure for pivotal rocking movement about a pivot axis in said median plane and spaced from said notional plane for exerting a percussive massage effect; and, a drive unit carried by said base structure and coupled with said massage head for producing said rocking movement of the head;

said base structure including a casing having a slender elongate handle for manipulating the massager, the handle extending about a longitudinal axis in said median plane, the massager being balanced about said plane;

wherein said drive unit comprises an electric motor having a driven rotary output shaft, and a link extending between said shaft and said massage head and including an eccentric bearing on said shaft, the link being coupled to the massage head at a position spaced from said median plane for converting rotary motion of the output shaft into rocking motion of the massage head about said pivot axis, and wherein said electric motor is positioned with its output shaft co-incident with said longitudinal axis of the handle;

the massager further comprising means coupled to said motor for mounting said massage head for rocking motion about said pivot axis, and a pair of resilient members disposed between said massage head and said mounting means so as to be alternately and oppositely compressed and relaxed as a consequence of said rocking movement of the massage head, for controlling said movement, wherein said resilient members being cylindrical sleeves, each having a first end received in a complimentary recess in said massage head, and a second end receiving a locating formation on said mounting means;

and wherein said massage surface is contoured to provide at least two generally hemispherical massage formations disposed symmetrically on opposite sides of said median plane.

2. A massager as claimed in claim 1, wherein said handle includes a fixed lower portion and a separable upper portion, said upper portion forming part of a casing which encloses said drive motor.

3. A massager as claimed in claim 2, further comprising a motor mount bracket which extends upwardly from said handle lower portion and extends around and embraces said drive motor from above, so that the motor is suspended from said motor mount bracket, said casing enclosing said motor and bracket.

4. A massager as claimed in claim 1, wherein each said massage formation comprises a dome-shaped inner base element, an outer cover which is removably coupled to said base element, and a separate and replaceable intermediate cushion member between said base element and said cover, said cushion member having resiliency characteristics selected to provide for a desired massage effect.

* * * * *